United States Patent [19]

Glenn

[11] Patent Number: 4,884,815

[45] Date of Patent: Dec. 5, 1989

[54] EDUCATIONAL AUTOMOTIVE GAME METHOD OF PLAY

[76] Inventor: Willie L. Glenn, 917 Pine Oak Trail, Austell, Ga. 30001

[21] Appl. No.: 186,921

[22] Filed: Apr. 27, 1988

[51] Int. Cl.[4] ..... A63F 3/00

[52] U.S. Cl. ..... 273/240; 273/272

[58] Field of Search ..... 273/272, 240, 299, 252

[56] References Cited

U.S. PATENT DOCUMENTS

| | | | |
|---|---|---|---|
| 1,211,103 | 1/1917 | Devlin | 273/272 |
| 3,746,342 | 7/1973 | Fine | 273/272 |
| 4,402,513 | 9/1983 | Head | 273/299 |

FOREIGN PATENT DOCUMENTS

| | | | |
|---|---|---|---|
| 1386097 | 3/1975 | United Kingdom | 273/252 |

OTHER PUBLICATIONS

Trivial Pursuit Master Game-Rules of Play, Selchow & Righter, 1981 Found in Group 330 Search Room.

*Primary Examiner*—Edward M. Coven
*Assistant Examiner*—Benjamin Layno
*Attorney, Agent, or Firm*—Leon Gilden

[57] ABSTRACT

An educational two-part game is set forth for use by three or more players. A "driver" or "monitor" controls the game between two or more "passengers" or participants. The "driver" initially picks a first card comprising an automotive "license tag" including at least a trio of letters followed by a three digit number wherein each "passenger" decodes the numbers and combines them with the letters already part of the "license plate" that yields seven to nine letters that each "passenger" must rearrange to develop a variety of words, wherein the "passenger" with the greatest number of words may proceed to part two to answer a trivia question and if correct, receives a predetermined number of points. The first "passenger" to develop one hundred pounts is declared the winner whereupon the participants may switch roles and maintain at least one "driver" and at least two "passengers". The game board provides a position for the "driver" and for the various "passengers" and includes a timing mechanism to limit the amount of time the "passengers" may utilize to develop a series of words per part one of the game. Accordingly, vocabulary development and knowledge of automobiles is enhanced as the "trivia" questions are all automotive related.

1 Claim, 3 Drawing Sheets

EDUCATIONAL AUTOMOTIVE GAME METHOD OF PLAY

BACKGROUND OF THE INVENTION

1. Field of the Invention

The invention relates to a board game for three or more players which has been developed to develop the players powers of word development and logical thinking and understanding of automotive knowledge.

2. Description of the Prior Art

The use of board games to develop mental capacities and exercise the thought processes of individuals is well known in the prior art. As may be appreciated, these devices have usually required a substantial amount of understanding of detailed rules to achieve the goal of mental development. Examples of prior art board games for this purpose are set forth wherein first example is U.S. Pat. No. 3,909,003 to Rabinovich wherein a puzzle game is presented wherein the individual utilizing the game solves a puzzle or multiple persons playing the a game and seek a mathematical relationship between various elements included in the game. The tablet means utilized in the game may be employed to substantially fully cover the playing area of two exemplary tray means or of any other substantial functional equivalence thereof. The game is based primarily upon the metric system for convenience to develop the proper mathematical relationship by the various elements of the puzzle game. The game, while of an interesting and useful mental exercising type, is of a relatively complex and remote organization as compared to that of the instant invention.

U.S. Pat. No. 4,077,630 to Kindred presents a board game utilizing nine playing areas wherein a first player hides a token which he covers with a shield, and a second player utilizes a number of test pieces which includes various characteristics of the playing pieces excluding one characteristic, such as a representation of a treasure chest. By the process of deductive reasoning, the second player tries to locate the playing piece of an opponent by first identifying at least some of the other pieces of the game. It may be appreciated that the game of Kindred is of interest relative to board games, but fails to present a teaching device as set forth by the instant invention and fails to provide the educational concept of word development, as utilized by the instant invention.

U.S. Pat. No. 4,378,941 to Derby utilizes a four-sided game board provided with a continuous path about the perimeter wherein the path is partitioned into various spaces which are recessed wherein all the spaces are blank with the exception of the four corners which represent the four individual starting points for the players. Tiles are utilized in the apparatus to construct the individual player segment of the playing board and by identification of different bird shapes and the like through habitat etc., the winner is developed by the player who first identifies a predetermined number of birds on the list or the most birds within a given time period. The identification game of Derby, as it may be appreciated, is of interest but of relatively limited teaching as opposed to the instant invention to develop vocabulary skills and knowledge of automobiles.

U.S. Pat. No. 4,607,848 to Maguire sets forth a word game involving the guessing of concealed words through definitional and phonetic clues. Dice are utilized to provide randomness and when words are properly guesses, a player covers the score board corresponding to the random number developed by the dice wherein the first player to fill a player scoreboard wins.

U.S. Pat. No. 4,640,513 to Montijo is essentially a memory game where players take turns trying to spell, pronounce and define words correctly. The Montijo patent is of interest to the utilization of vocabulary and to this limited extent, is of interest relative to the instant invention.

As such, it may be appreciated that there is a continuing need for a new and improved educational automotive game which addresses both the problem of vocabulary development and automotive knowledge development and in this respect, the present invention substantially fulfills this need.

SUMMARY OF THE INVENTION

In view of the foregoing disadvantages inherent in the known types of board games now present in the prior art, the present invention provides an educational automotive game wherein the same may be readily understood and effectively utilized to enhance vocabulary, word association, and word development and further provide an understanding of automotive science during periods of use. As such, the general purpose of the present invention, which will be described subsequently in greater detail, is to provide a new and improved education automotive game which has all the advantages of the prior art board games and none of the disadvantages.

To attain this, the present invention comprises a board game wherein at least three players and up to four may participate. One player is designated as "driver" wherein the remaining players are designated as "passengers". A replica automotive license plate is imprinted on a series of "car tag" cards wherein the "driver" initially selects a first "car tag" with a sequence of three letters followed by a sequence of three numerical digits. Each player upon commencement of the round utilizes an alphabetical code to translate the numbers on the license plate replica to alphabetic letters whereupon the "passengers" then develop as many words as possible in an effort to unscramble the letters developed in the miniature license plate. The "passenger" who develops the most words within the given time sequence may then proceed to the "trivia" round whereupon a correct trivia question response results in an award of a predetermined number of points. After a number of rounds, the player or "passenger" with the attainment of a predetermined numerical goal is declared the winner. In the event of a tie between "passengers", each "passenger" may be allowed to participate in the "trivia" round. Should there be a tie between "passengers" in attaining a predetermined point goal, then the rounds are continued until a winner is declared.

My invention resides not in any one of these features per se, but rather in the particular combination of all of them herein disclosed and claimed and it distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational automotive game which has all the advantages of the prior art board games and none of the disadvantages.

It is another object of the present invention to provide a new and improved educational automotive game which may be easily and efficiently manufactured and marketed.

It is a further object of the present invention to provide a new and improved educational automotive game which is of a durable and reliable construction.

An even further object of the present invention is to provide a new and improved educational automotive game which is susceptible of a low cost of manufacture with regard to both materials and labor, and which accordingly is then susceptible of low prices of sale to the consuming public, thereby making such educational automotive games economically available to the buying public.

Still yet another object of the present invention is to provide a new and improved educational automotive game which provides in the apparatuses and methods of the prior art some of the advantages thereof, while simultaneously overcoming some of the disadvantages normally associated therewith.

Still another object of the present invention is to provide a new and improved educational automotive game to develop vocabulary, skills and automotive knowledge and understanding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
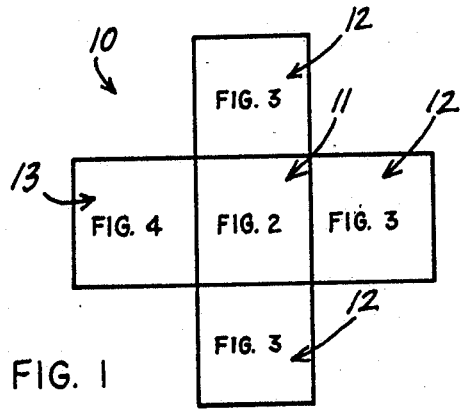
FIG. 1 is a top orthographic diagrammatic view of the playing board as utilized by the instant invention with the various designated details of the playing board set forth in subsequent FIGS. 10.

With reference now to the drawings, and in particular to FIGS. 1 to 12 thereof, a new and improved educational automotive game embodying the principles and concepts of the present invention and generally designated by the reference numeral 10 will be described.

More specifically, it will be noted that the educational automotive game 10 essentially comprises a game board of a generally crossed rectangular configuration, as illustrated in FIG. 1. The game board is divided into various section as set forth with a central alphabet code translation station 11, a trio of perimeter "passenger" stations 12 and a "driver" station 13 wherein the playing board is formed with a plastic-like coating for erasure and reuse of the "driver" stations, as will be subsequently discussed in greater detail.

Figure 2:
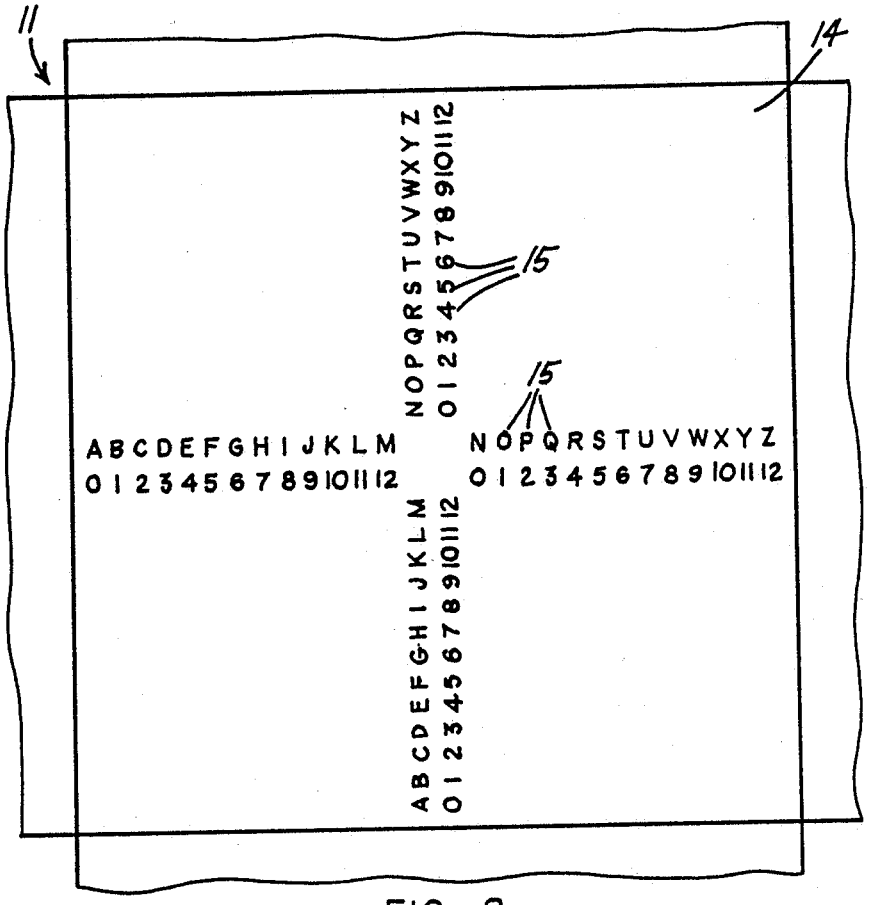
FIG. 2 is a top orthographic view of the alphabetic code positioned centrally of the playing board.

The alphabet code translation station 11, as illustrated in FIG. 2, is formed with a planar surface 14 with a plurality of central or orthogonally oriented code translation displays presented from one side of the planar surface 14 to the other in a crossing arrangement to enable visual access by all participating players.

Figure 3:
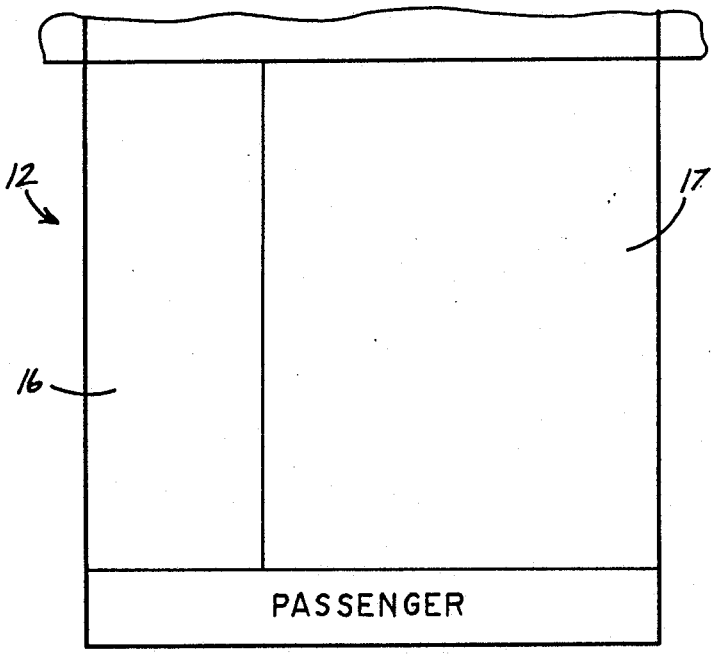
FIG. 3 is a top orthographic view of the various "passenger" positions in the playing board.
Figure 4:
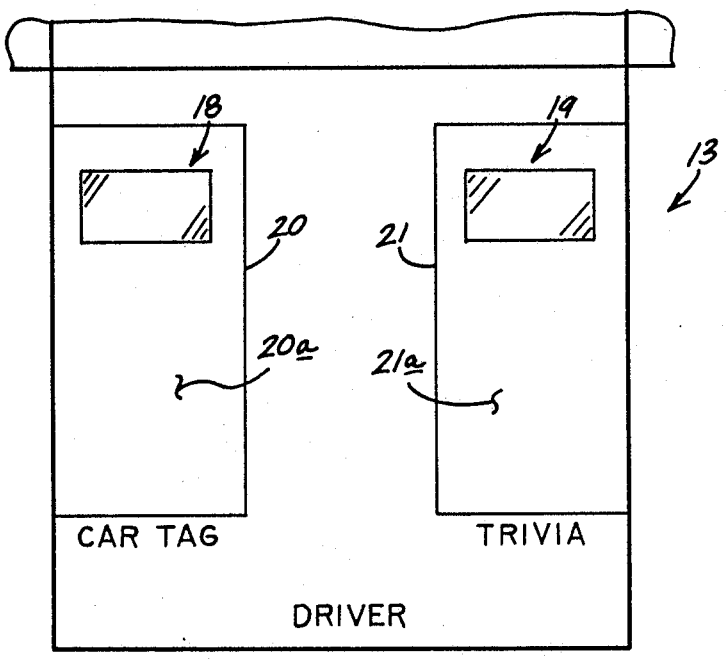
FIG. 4 is a top orthographic diagrammatic representation of the "driver" station of the playing board of FIG. 1.

Each "passenger" station 12, as illustrated in FIG. 3, is formed as planar surface with a point tabulation portion 16 and a work area 17. The point tabulation portion 16 is conveniently oriented for tabulation of point totals achieved by each participating "passenger" or player wherein work area 17 is utilized by each participant to develop the various vocabulary words, as exemplified in FIGS. 10 and 11. The "driver" station 13, as illustrated in FIG. 4, is formed as an extension of the planar surface of the playing board of FIG. 1 with a "car tag" containment area 20 and a "trivia" card containment area 21. A stack of "car tag" cards 18 are positioned upwardly of the "car tag" containment area 20 with an associated stack of "trivia" cards 19 positioned upwardly of the "trivia" card containment area 21. With use of the various cards, a "car tag" discard area **20*a* and a respective "trivia" card discard area 21*a*** is defined underlying the cards for positioning to avoid their inadvertent reuse. It is contemplated that at least one hundred "car tag" cards and one hundred "trivia" cards are utilized in the game to maintain a fresh supply of such cards to the participants without unnecessary repetition in use of the cards.

Figure 5:
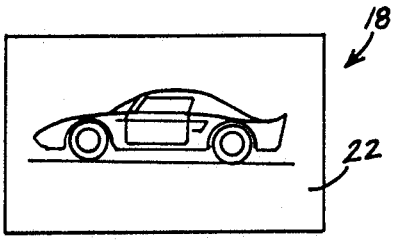
FIG. 5 is a top orthographic representation of a typical "car tag" utilized by the instant invention.
Figure 8:
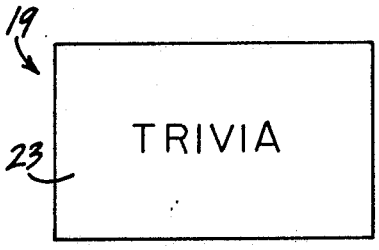
FIG. 8 is a top orthographic view of a "trivia" card as utilized in the playing of the instant invention.
Figure 6:
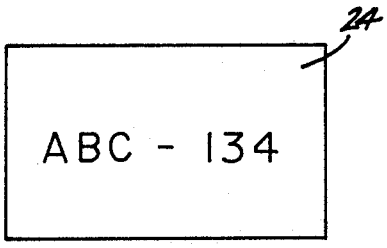
FIG. 6 is an orthographic diagrammatic representation of an example of a "car tag" as utilized in the playing of the instant invention.
Figure 7:
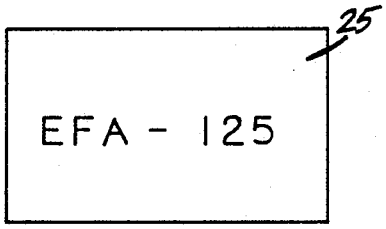
FIG. 7 is an orthographic view representative of another example of a "car tag" utilized by the playing of the instant invention.
Figure 12:
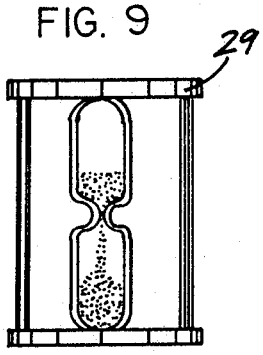
FIG. 12 is an orthographic view taken in elevation of a timer as utilized by the instant invention.
Figure 10:
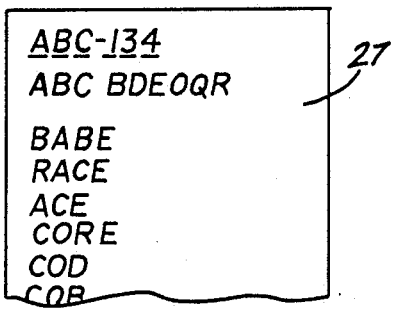
FIGS. 10 and 11 are top orthographic views of examples of utilizing the "car tag" examples set forth in FIGS. 6 and 7.
Figure 11:
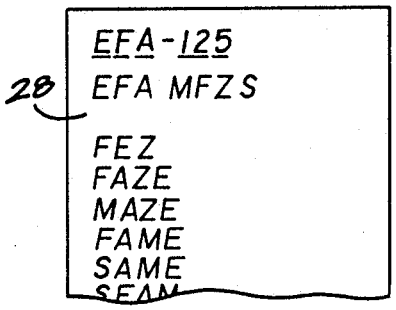

FIG. 5 illustrates a typical "car tag" 18 whose top surface is consistent throughout the array and stack of cards wherein the top surface of the cards 22 may have a designated picture of an automobile consistent with the theme of the game. The reverse side of the "car tag" cards 24 is exemplified in FIGS. 6 and 7 wherein an example of ABC-134 and EFA-125 are presented in FIG. 6 and 7 respectively. The FIGS. 10 and 11 illustrate the development of the words by each participant wherein the representative license plate depicted in FIGS. 6 and 7 is set forth at the top of each of the examples. The "car tag" card example 1 expanded sets forth ABC-134 from FIG. 6. With reference to the alphabet code translation station 11, the numerals 134 provide the various letters in the second line of the example of FIG. 10. Therefore in the second line, addition to the originally presented letters ABC, the letter DBE from the left side of the alphabet are derived, as exemplified in FIG. 2, wherein the D is adjacent the 3, the B adjacent the 1, and the E adjacent the 4. With reference to the right side of the alphabet of N through Z, the O is adjacent the 1, the Q is adjacent the 3, and the R is adjacent the 4 to develop the letters as presented in the second line of FIG. 10. Examples of the potential words to be developed are listed below the second line in FIG. 10 and are merely exemplary and not limiting of the potential words available. It may be appreciated therefore that the timer 29, as illustrated in FIG. 12, is utilized to limit the "passengers" or participants with the "driver" being in control and presenting a "car tag" in a one at a time manner to each "passenger" for a thirty-second interval. It has been developed that the thirty-second interval is adequate to enable each participant to develop an appropriate listing of words and thereby improve the participant's skill and mental dexterity in the development of such words.

Figure 9:
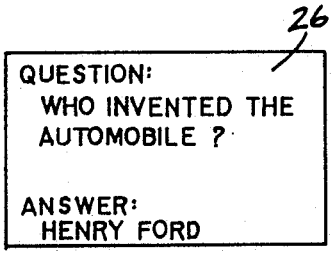
FIG. 9 is an orthographic top view of an example of a "trivia" card as utilized in the playing of the instant invention.

A "passenger" with the greatest listing of correct words may then proceed to attempt to answer a "trivia" card which the "driver" then picks from the stack 19 and exemplified in FIG. 9 with a typical question and appropriate response. Upon a correct response by a participant, the participant is then awarded twenty points and may at that juncture enter the twenty point award in the point tabulation area 16, as illustrated in FIG. 3. In this manner, the first participant or "passenger" to develop one hundred points is declared the winner.

In the event of a tie in the development of words through the use of the "car tags" as illustrated in FIGS. 10 and 11, each "passenger" or participant may then attempt to respond to a "trivia" question to obtain the desired point. Should there be a tie between participants obtaining one hundred points, then additional rounds are played until a winner is declared.

The manner of usage and operation of the present invention therefore should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of playing an education automotive game comprising the steps of, providing a playing board with a plurality of player positions designated passenger stations, a single player driver station, and an alphabet code translation station positioned centrally of said passenger and driver stations, and providing a plurality of automotive license plate replica cards with respective representative automotive license plate sides positioned face down on a designated area of the drive station, and providing a plurality of automotive question cards with an automotive related question set forth on one side of the question cards and said sides of said cards positioned face down on a further designated area of the driver station, and wherein a further step designates a first participant as a driver and at least a plurality of further participants are designated as passengers, and the driver subsequently selects a single automotive license plate replica card with a plurality of letters and a plurality of numerical digits thereon, wherein a further step requires each passenger to utilize the code translation station to translate the numerical digits into corresponding alphabetic letters, and a further step requires each passenger to subsequently develop as many words as possible from the collections of said plurality of letters and translated numerical digits;

a further step requires said driver to subsequently select a question card and request a correct response from a winning passenger developing the greatest number of said words; and awarding a point to said winning passenger upon correct response from said winning passenger to said driver presenting said winning passenger with said automotive question from said selected question card, and wherein said driver upon selecting said single automotive license plate replica card utilizes a timing device to present said passengers with a preset time for developing as many of said words as possible, and further including a step of deciding an ultimate winner of said game upon a respective passenger attaining a predetermined point to total, and including the step of further playing of the game subsequent to a passenger attaining said preselected point total upon two or more passengers attaining said preselected point total simultaneously.

* * * * *